US009031461B2

(12) United States Patent
Embry et al.

(10) Patent No.: US 9,031,461 B2
(45) Date of Patent: May 12, 2015

(54) TRANSFER ROLL ASSEMBLY FOR AN ELECTROPHOTOGRAPHIC IMAGE FORMING DEVICE

(71) Applicant: Lexmark International, Inc., Lexington, KY (US)

(72) Inventors: Kerry Leland Embry, Midway, KY (US); Bartley Charles Gould, II, Lexington, KY (US); James Philip Harden, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 43 days.

(21) Appl. No.: 13/862,536

(22) Filed: Apr. 15, 2013

(65) Prior Publication Data

US 2014/0270846 A1 Sep. 18, 2014

Related U.S. Application Data

(60) Provisional application No. 61/789,436, filed on Mar. 15, 2013.

(51) Int. Cl.
*G03G 15/16* (2006.01)
*G03G 21/16* (2006.01)

(52) U.S. Cl.
CPC ..... *G03G 21/1633* (2013.01); *G03G 21/1638* (2013.01); *G03G 21/168* (2013.01)

(58) Field of Classification Search
CPC ..... G03G 21/1614; G03G 21/1633; G03G 21/1647; G03G 21/168; G03G 2221/1642; G03G 2221/1654; G03G 2221/169
USPC ..... 399/121, 302, 313, 318
See application file for complete search history.

(56) References Cited

U.S. PATENT DOCUMENTS

| | | | | |
|---|---|---|---|---|
| 5,434,655 | A | 7/1995 | Okamura | |
| 7,162,182 | B2 | 1/2007 | Tonges et al. | |
| 8,219,012 | B2 | 7/2012 | Embry et al. | |
| 8,478,165 | B2 * | 7/2013 | Somemiya et al. | 399/124 |
| 8,521,063 | B2 * | 8/2013 | Saito et al. | 399/121 |
| 8,774,674 | B2 * | 7/2014 | Tokunaga et al. | 399/110 |
| 2011/0091238 | A1 * | 4/2011 | Nakazawa | 399/110 |
| 2011/0110684 | A1 * | 5/2011 | Sato et al. | 399/121 |
| 2011/0110685 | A1 * | 5/2011 | Sato et al. | 399/121 |
| 2011/0318070 | A1 | 12/2011 | Whitney et al. | |
| 2012/0099896 | A1 * | 4/2012 | Kamano | 399/121 |
| 2012/0163863 | A1 * | 6/2012 | Murashima | 399/121 |
| 2013/0000207 | A1 | 1/2013 | Cook et al. | |
| 2013/0077992 | A1 * | 3/2013 | Shirai et al. | 399/121 |
| 2013/0108320 | A1 * | 5/2013 | Ju et al. | 399/121 |
| 2013/0272745 | A1 * | 10/2013 | Fukase | 399/121 |

* cited by examiner

*Primary Examiner* — David Gray
*Assistant Examiner* — Carla Therrien
(74) *Attorney, Agent, or Firm* — Justin M Tromp

(57) ABSTRACT

An image forming device according to one example embodiment includes a housing having an access door manually movable between a closed position and an open position. A carriage is mounted on an inner portion of the access door. A first roll is rotatably mounted to the carriage and forms a nip with a second member positioned in the interior of the housing when the access door is closed. The first roll is spaced away from the second member when the access door is open. The carriage is free to move relative to the access door and is biased away from the access door toward the second member. A clamping assembly is configured to clamp the first roll against the second member to form the nip as the access door is closed and unclamp the first roll from the second member as the access door is opened.

16 Claims, 10 Drawing Sheets

TRANSFER ROLL ASSEMBLY FOR AN ELECTROPHOTOGRAPHIC IMAGE FORMING DEVICE

CROSS REFERENCES TO RELATED APPLICATIONS

This application claims priority to U.S. Provisional Patent Application Ser. No. 61/789,436, filed Mar. 15, 2013, entitled "A Transfer Roll Assembly for an Electrophotographic Image Forming Device," the content of which is hereby incorporated by reference in its entirety.

BACKGROUND

1. Field of the Disclosure

The present disclosure relates generally to image forming devices and more particularly to a transfer roll assembly for an electrophotographic image forming device.

2. Description of the Related Art

Color electrophotographic image forming devices such as color laser printers and copiers often utilize an endless belt referred to as an intermediate transfer member trained about various rotatable rolls. The intermediate transfer member is positioned adjacent multiple photoconductive drums. During a print operation, at a series of first transfer nips, each of the photoconductive drums supplies a different color toner (e.g., black, cyan, yellow or magenta) to the surface of the revolving intermediate transfer member in a layered fashion forming a color toner image. The toner image is transferred from the surface of the intermediate transfer member to a media sheet as the sheet moves through a second transfer nip formed between a rotating transfer roll and the intermediate transfer member. The intermediate transfer member is supported against the transfer roll by one or more backup rolls. After the media sheet receives the toner image from the intermediate transfer member, the sheet proceeds to a fuser that bonds the toner image to the media sheet by applying heat and pressure. The relative proportions of each color toner contained in the toner image on the media sheet dictate the final color(s) of the image(s) on the sheet.

Media sheets may tend to catch or jam along the media path inside the image forming device requiring user intervention to clear the media path by removing the jammed sheet(s). For example, media jams may occur between the second transfer nip and the fuser. Some devices include an access door that, when opened, separates the transfer roll from the intermediate transfer member thereby opening the second transfer nip and permitting access to a media sheet jammed between the second transfer nip and the fuser.

SUMMARY

An image forming device according to one example embodiment includes a housing having an access door manually movable between a closed position and an open position permitting access to an interior of the housing. A carriage is mounted on an inner portion of the access door. A first roll is rotatably mounted to the carriage. The first roll forms a nip with a second member positioned in the interior of the housing when the access door is in the closed position. The first roll is spaced away from the second member when the access door is in the open position. The carriage is free to move relative to the access door and is biased away from the access door toward the second member. A clamping assembly is configured to clamp the first roll against the second member to form the nip as the access door is closed and unclamp the first roll from the second member as the access door is opened.

An image forming device according to another example embodiment includes a housing having an intermediate transfer member in an interior portion thereof positioned to receive a toned image from each of a plurality of photoconductive drums at a series of first transfer nips and to convey the toned images received from the plurality of photoconductive drums at a second transfer nip formed between the intermediate transfer member and a transfer roll. An access door on the housing is manually movable between a closed position and an open position permitting access to the intermediate transfer member. An inner door frame on an inner portion of the access door has a first side and a second side. A carriage is mounted on the inner door frame. The transfer roll is rotatably mounted to the carriage. The transfer roll forms the second transfer nip with the intermediate transfer member when the access door is in the closed position and is spaced away from the intermediate transfer member when the access door is in the open position. The carriage is free to move relative to the access door and is biased away from the access door toward the intermediate transfer member. A first upper pivotal arm and a first lower pivotal arm are positioned on the first side of the inner door frame. A second upper pivotal arm and a second lower pivotal arm are positioned on the second side of the inner door frame. The first upper pivotal arm and the first lower pivotal arm are connected by a first spring. The second upper pivotal arm and the second lower pivotal arm are connected by a second spring. A first guide member is positioned to guide the movement of one of the first upper arm and the first lower arm as the access door is opened and closed and a second guide member is positioned to guide the movement of one of the second upper arm and the second lower arm as the access door is opened and closed. A first pivotal guide lever is actuatable by the other of the first upper arm and the first lower arm and a second pivotal guide lever is actuatable by the other of the second upper arm and the second lower arm to clamp the transfer roll against the intermediate transfer member to form the second transfer nip as the access door is closed and unclamp the transfer roll from the intermediate transfer member as the access door is opened.

A carriage mountable to an inner portion of an access door of an image forming device according to one example embodiment includes a body having a first end and a second end, a first side, a second side, a top and a bottom extending between the first end and the second end. A roll is rotatably mounted on the first end of the body unobstructed for forming a nip with a corresponding member in the image forming device. The roll is free to flex toward and away from the first end of the body and is biased away from the first end of the body. A first guide member on the first side of the body and a second guide member on the second side of the body are positioned to guide end-to-end movement of the body.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
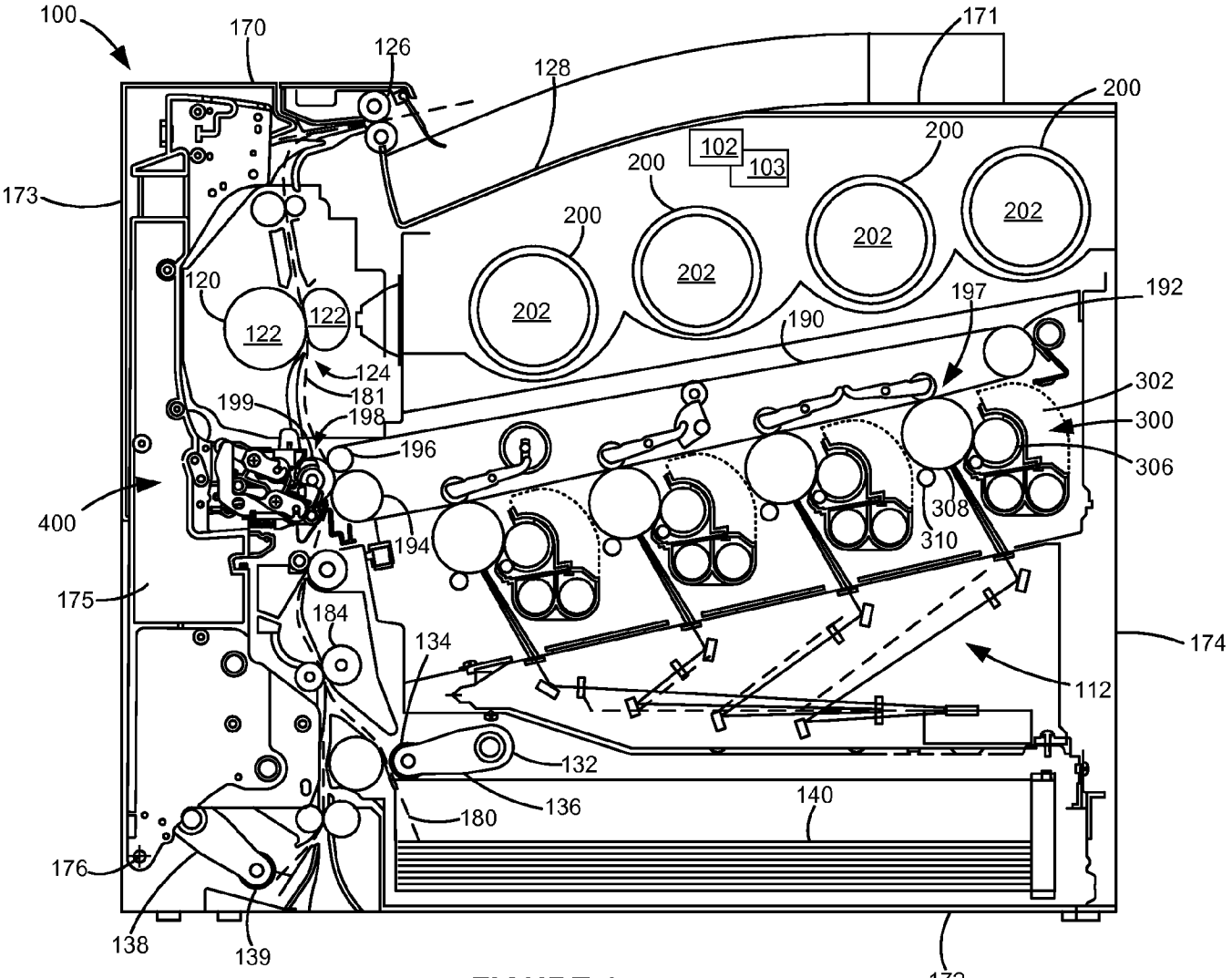
FIG. 1 is a schematic diagram of an image forming device according to a first example embodiment with an access door in a closed position.

Referring now to the drawings and more particularly to FIG. 1, there is shown a schematic view of an example image forming device 100. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may also include a duplex path as desired. A media sheet is introduced into simplex path 181 from tray 140 by a pick mechanism 132. In the example embodiment shown, pick mechanism. 132 includes a roll 134 positioned at the end of a pivotable arm 136. Roll 134 rotates to move the media sheet from tray 140 into media path 180. The media sheet is then moved along media path 180 by various transport rolls 184. Media sheets may also be introduced into media path 180 by a manual feed 138 having one or more rolls 139.

In the example embodiment shown, image forming device 100 includes four toner cartridges (or toner bottles) 200 removably mounted in housing 170 in a mating relationship with four corresponding imaging units 300 also removably mounted in housing 170. Each toner cartridge 200 includes a reservoir 202 for holding toner and an outlet port in communication with an inlet port of its corresponding imaging unit 300 for transferring toner from reservoir 202 to a reservoir 302 in the imaging unit 300. For example, in one embodiment toner moves through a chute that connects the outlet port of a toner cartridge 200 to the inlet port of the corresponding imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include black, cyan, yellow and magenta toner, respectively. In the example embodiment illustrated, image forming device 100 utilizes what is commonly referred to as a dual component developer system. In this embodiment, the toner in each reservoir 302 is mixed with magnetic carrier beads. The magnetic carrier beads may be coated with a polymeric film to provide triboelectric properties to attract toner to the carrier beads as the toner and the magnetic carrier beads are mixed in reservoirs 302. In this embodiment, each imaging unit 300 includes a magnetic roll 306 and a photoconductive drum 308. Photoconductive drums 308 are mounted substantially parallel to each other when the imaging units 300 are installed in image forming device 100. For purposes of clarity, the components of only one of the imaging units 300 are labeled in FIG. 1. In the example embodiment illustrated, each imaging unit 300 is substantially the same except for the color of toner contained therein.

Each photoconductive drum 308 forms a nip with a corresponding charging roll 310. During a print operation, charging roll 310 charges the surface of photoconductive drum 308 to a specified voltage such as, for example, −1000 volts. A laser beam from a laser scan unit 112 is then directed to the surface of each photoconductive drum 308 and selectively discharges those areas it contacts to form a latent image. In one embodiment, areas on photoconductive drum 308 illuminated by the laser beam are discharged to approximately −300 volts. Magnetic rolls 306 attract the magnetic carrier beads having toner thereon to magnetic roll 306 through the use of magnetic fields and transport the toner to the corresponding photoconductive drum 308. Electrostatic forces from the latent image on photoconductive drum 308 strip the toner from the magnetic carrier beads to provide a toned image on the surface of photoconductive drum 308 in the areas discharged by the laser beam from LSU 112. The toner is attracted to the areas of the surface of photoconductive drum 308 discharged by the laser beam from LSU 112.

An intermediate transfer mechanism (ITM) 190 is disposed adjacent to the photoconductive drums 308. ITM 190 is formed as an endless belt trained about a drive roll 192 and backup rolls 194, 196. During image forming operations, ITM 190 moves past photoconductive drums 308 in a clockwise direction as viewed in FIG. 1. One or more of photoconductive drums 308 apply toner images in their respective colors to ITM 190 at a first transfer nip 197. In one embodiment, a positive voltage field attracts the toner image from photoconductive drums 308 to the surface of the moving ITM 190, ITM 190 rotates and collects the one or more toner images from photoconductive drums 308 and then conveys the toner images to a media sheet at a second transfer nip 198 formed by a transfer roll 199 and backup rolls 194, 196.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip 124 to adhere the toner image to the media sheet. The fused media sheet then passes through exit rolls 126 located downstream from fuser 120. In some embodiments, exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into a duplex path as desired for image formation on a second side of the media sheet.

In one embodiment, instead of a dual component development system, image forming device 100 utilizes a single component development system. In this embodiment, each imaging unit 300 includes a toner adder roll and a developer roll as well as a photoconductive drum 308. The toner adder roll moves toner from reservoir 302 to the developer roll. A metering device such as a doctor blade meters toner onto developer roll 306 and applies a desired charge on the toner. The developer roll forms a nip with the photoconductive drum 308 of the imaging unit 300 and transfers toner to the areas on the surface of the photoconductive drum 308 discharged by the laser beam from LSU 112.

Image forming device 100 includes a controller 102. Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 controls the operation of image forming device 100 and processes print data. As desired, image forming device 100 may include an integrated scanner system for document scanning and copying. In this embodiment, controller 102 may be a combiner printer and scanner controller.

In one embodiment, image forming device 100 includes a user interface (not shown) mounted on an exterior portion of housing 170. Using the user interface, a user is able to enter commands and generally control the operation of the image forming device 100. For example, the user may enter commands to switch modes (e.g., color mode, monochrome mode), view the number of pages printed, etc.

Figure 2:
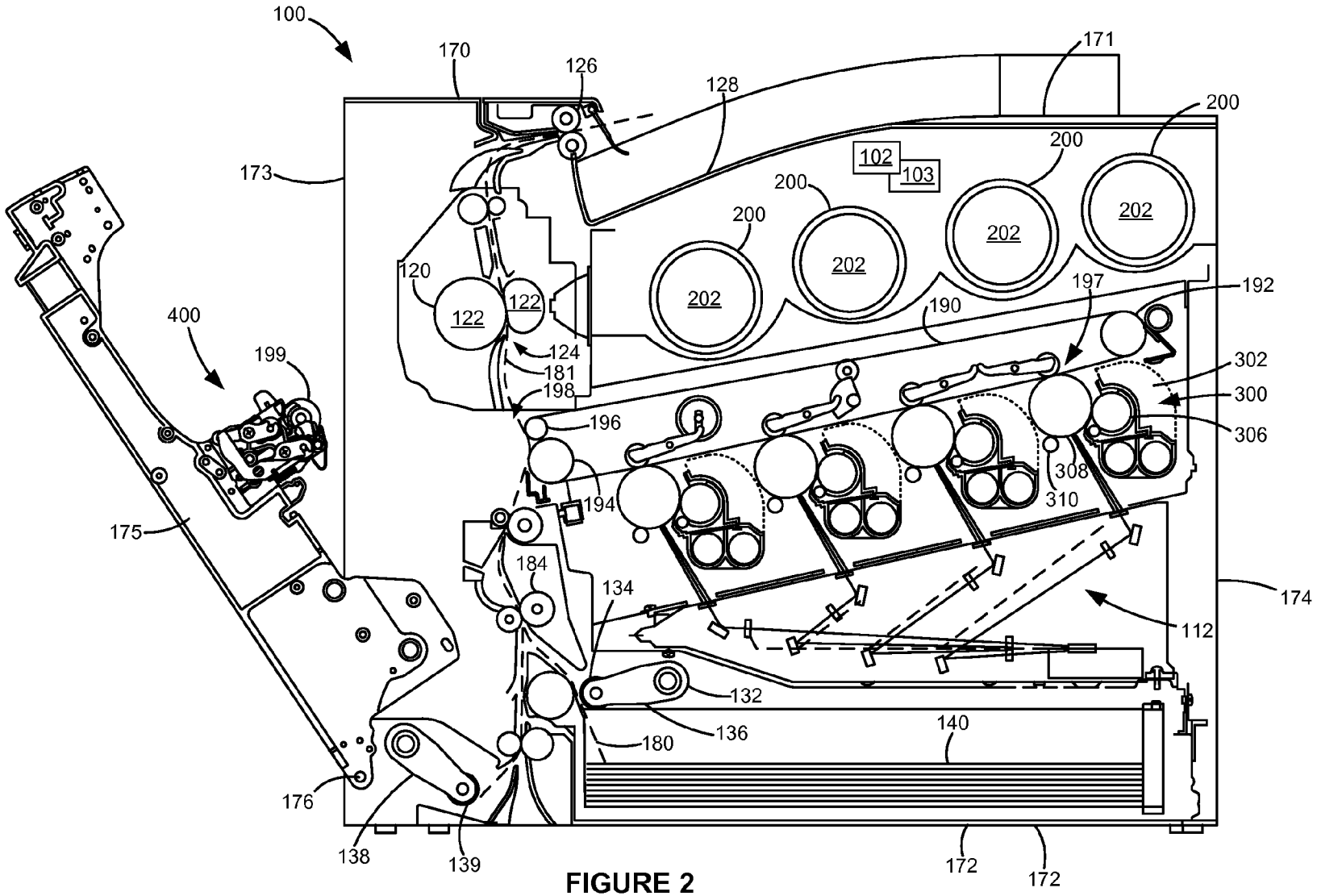
FIG. 2 is a schematic diagram of the image forming device shown in FIG. 1 with the access door in an open position.

Image forming device 100 includes an access door 175 on front 173 of housing 170. Access door 175 manually opens and closes to permit a user to clear a media jam in simplex path 181 between pick mechanism 132 and fuser 120. FIG. 1 shows access door 175 in a closed position and FIG. 2 shows access door 175 in an open position. As shown in FIG. 2, transfer roll 199 is attached to access door 175 such that when access door 175 is opened, transfer roll 199 separates from ITM 190 and backup rolls 194, 196 opening second transfer nip 198. This provides a user with greater access to a media sheet jammed in this region of simplex path 181.

Figure 3:
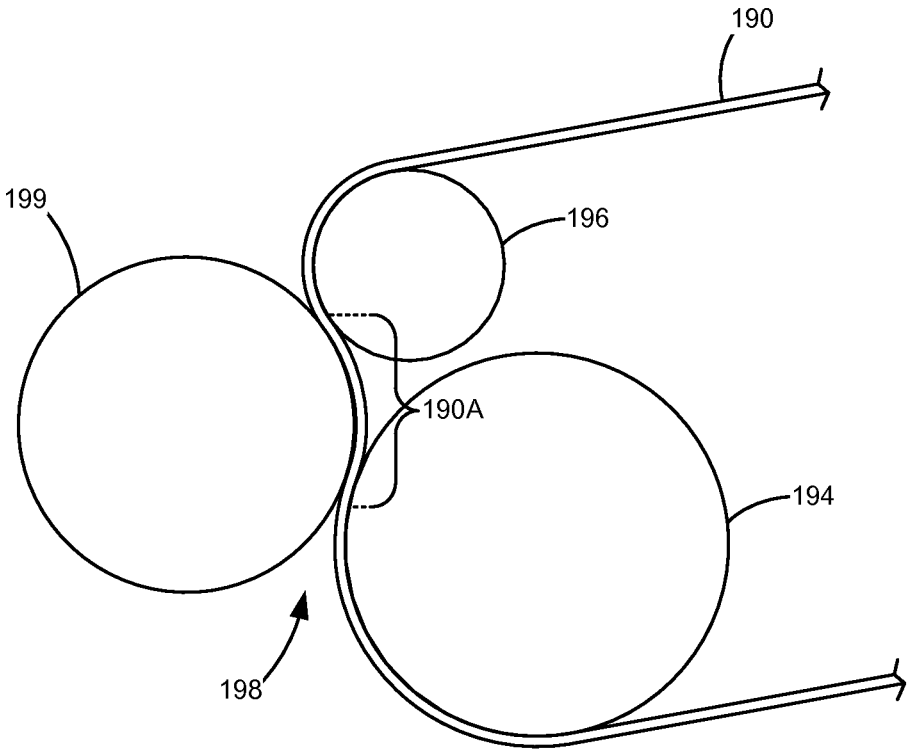
FIG. 3 is an enlarged schematic view of a second transfer nip of the image forming device shown in FIGS. 1 and 2 according to a first example embodiment.
Figure 4:
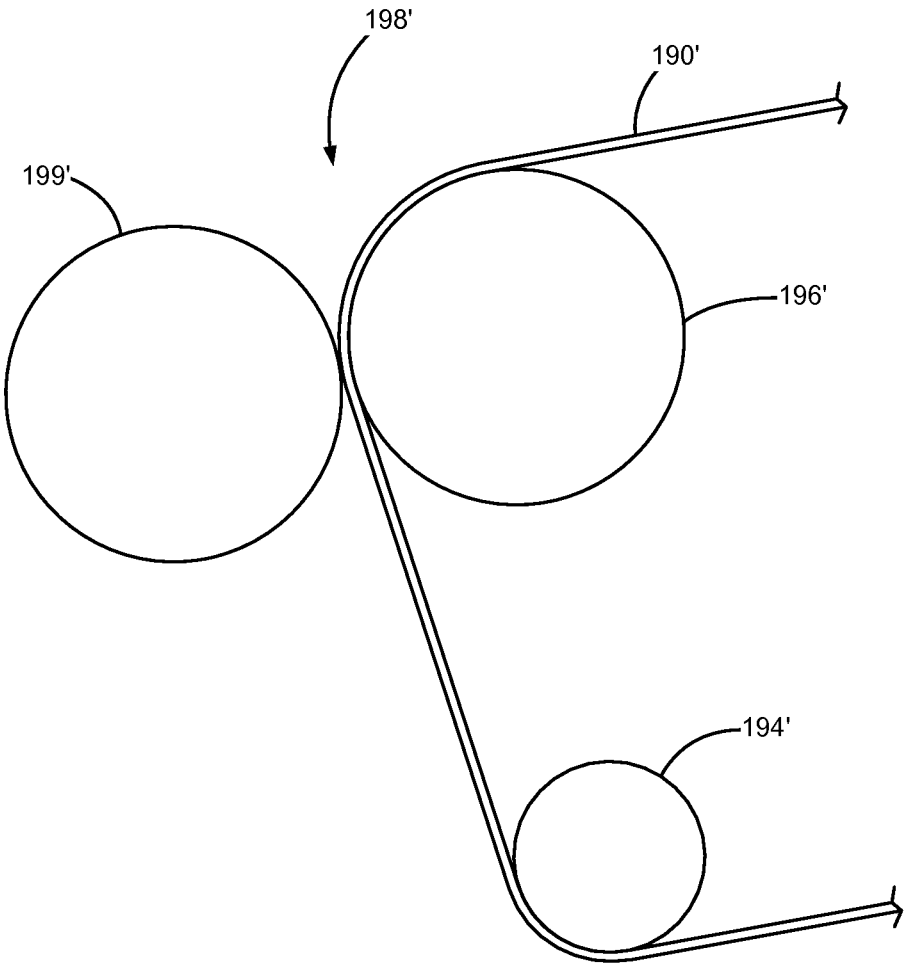
FIG. 4 is a schematic view of a second transfer nip according to a second example embodiment.

FIG. 3 shows an enlarged view of second transfer nip 198 according to one embodiment. In this embodiment, second transfer nip 198 is formed by transfer roll 199 and backup rolls 194, 196. Specifically, ITM 190 travels between transfer roll 199 and backup rolls 194, 196 such that a media sheet traveling along simplex path 181 receives a toner image from ITM 190 as the sheet travels (upward as viewed in FIG. 3) between transfer roll 199 and ITM 190. As shown in FIG. 3, ITM 190 bends under backup roll 194 and over backup roll 196. When access door 175 is in the closed position as shown in FIG. 3, transfer roll 199 causes a portion 190A of ITM 190 positioned between backup roll 194 and backup rob 196 to bend inward, away from access door 175 (to the right as viewed in FIG. 3). This causes portion 190A of ITM 190 to conform to the shape of the outer surface of transfer rob 199 increasing the surface area of ITM 190 in contact with transfer roll 199 in comparison with a nip formed between a transfer roll and a single backup roll. For example, FIG. 4 illustrates a second transfer area 198' formed by a transfer roll 199' and a backup roll 196'. An ITM 190' travels between transfer roll 199' and backup roll 196'. A tension roll 194' maintains the tension of ITM 190'. As shown in FIG. 4, in this embodiment, the surface area of ITM 190' that conforms to the shape of transfer roll 199' is relatively small in comparison with the surface area of 190 that conforms to the shape of transfer roll 199 shown in FIG. 3. Second transfer nip 198 shown in FIG. 3 may be referred to as a "wide" nip while second transfer nip 198' shown in FIG. 4 may be referred to as a "narrow" nip. In order to provide a nip pressure in the wide second transfer nip 198 that is equivalent to the nip pressure of the narrow second transfer nip 198' to ensure proper contact between ITM 190 and a media sheet, the loading force of transfer roll 199 normal to the surface of ITM 190 must be increased relative to the loading force of transfer roll 199'. Specifically, the loading force of transfer roll 199 must be increased in proportion to the increase in surface area of wide second transfer nip 198 as compared to narrow second transfer nip 198'. Despite this increased loading force, it is desired to require a minimal input force from a user to manually open and close access door 175. If the input force required for the user is too high, it may be difficult or unpleasant for a user to open and close access door 175. Accordingly, image forming device 100 includes a transfer roll assembly 400 (FIGS. 1 and 2) that reduces the force required by the user to open and close access door 175.

Figure 5:
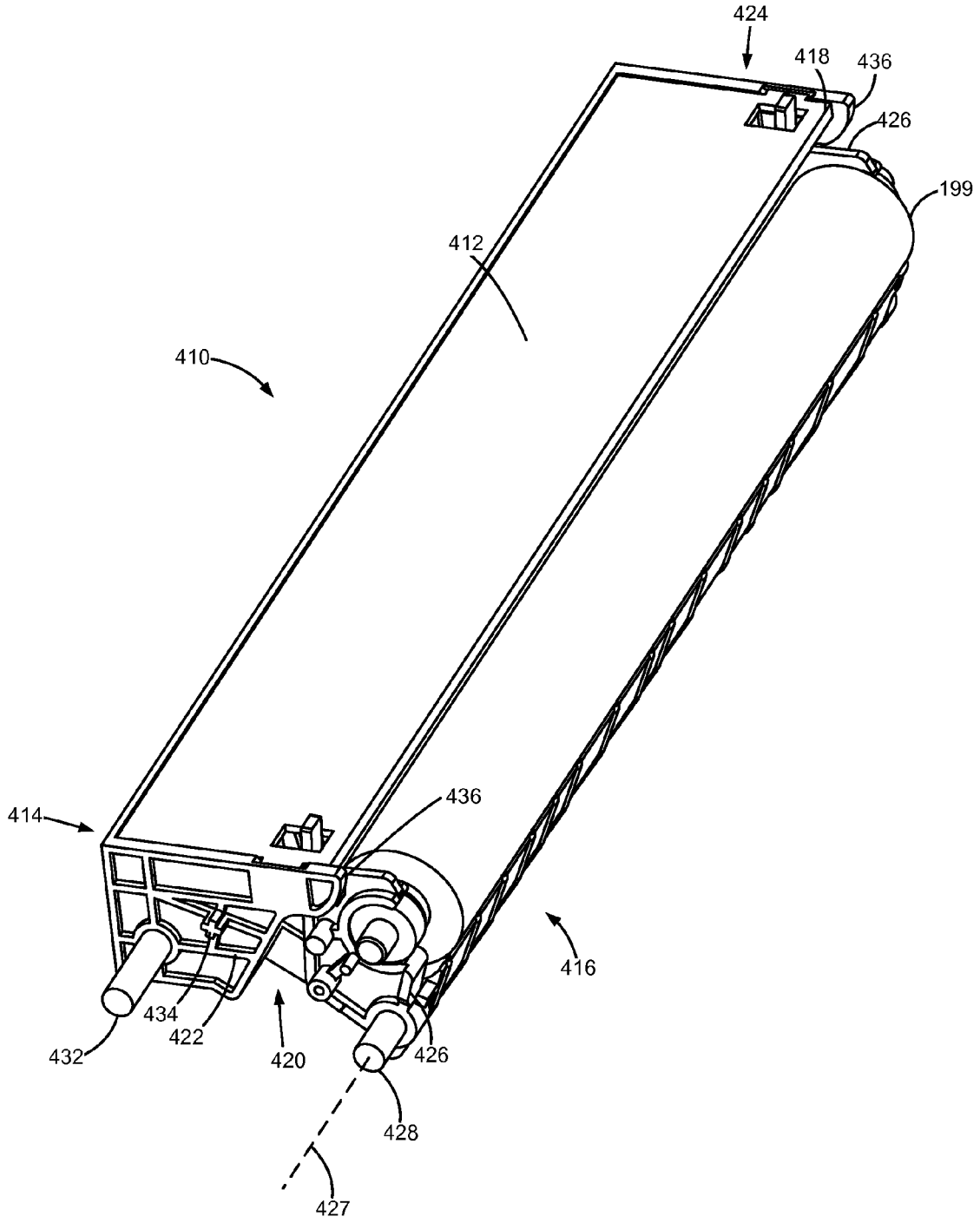
FIG. 5 is a perspective view of a carriage body of a transfer roll assembly for an image forming device according to one example embodiment.

With reference to FIG. 5, transfer roll assembly 400 includes a carriage 410 that mounts on an inner portion of access door 175 as discussed in greater detail below. Carriage 410 includes a carriage body 412. Carriage body 412 includes a proximal end 414 positioned near access door 175 and a distal end 416 positioned away from access door 5. Proximal end 414 and distal end 416 are connected by a top 418, a bottom 420 and a pair of sides 422, 424 of body 412. In the embodiment illustrated, some of the features of side 424 are obscured by carriage body 412; however, sides 422, 424 are substantially mirror images of each other unless stated otherwise. Transfer roll 199 is rotatably mounted on distal end 416 of carriage body 412 for engagement with ITM 190 when access door 175 is closed. In the example embodiment illustrated, body 412 includes a pair of bell cranks 426 each pivotally mounted about a pivot axis 427 on distal end 416 of body. One of the pair of bell cranks 426 is positioned near side 422 and the other near side 424. Transfer roll 199 is mounted at its ends to bell cranks 426 at a position spaced away from pivot axis 427 of bell cranks 426. In the embodiment shown, body 412 includes a pair of mounting posts 428 extending outward from side 422 and side 424, respectively, near distal end 416 of carriage body 412. Bell cranks 426 are mounted on mounting posts 428 with mounting posts 428 defining pivot axis 427 of bell cranks 426. In the embodiment shown, mounting posts 428 extend near bottom 420; however, this configuration may be flipped vertically such that mounting posts 428 (and the pivot axis 427 of bell cranks 426) may be positioned near top 418 instead (or at any other suitable point along carriage body 412). Bell cranks 426 and transfer roll 199 are biased away from access door 175, toward ITM 190 (i.e., to the right as viewed in FIG. 5) by one or more biasing members. For example, in one embodiment, a pair of compression springs (not shown) are positioned at a first end against a respective bell crank 426 and at a second end against an inner surface of carriage body 412. In this embodiment, the compression springs bias bell cranks 426 and transfer roll 199 away from access door 175. Each side 422, 424 of carriage body 412 includes at least one guide member such as, for example, a lower guide post 432 and an upper guide post 434 extending outward therefrom. Guide posts 432, 434 are received by corresponding slots in access door 175 to limit the motion of carriage 410 relative to access door 175 as discussed in greater detail below. Carriage body 412 also includes a pair of stops 436 that limit the forward travel of carriage body when access door 175 is closed as discussed in greater detail below. In the embodiment shown, stops 436 are positioned at distal end 416 of carriage body 412 near top 418. In this embodiment, one stop 436 is positioned near side 422 and the other stop 436 is positioned near side 424.

Figure 6:
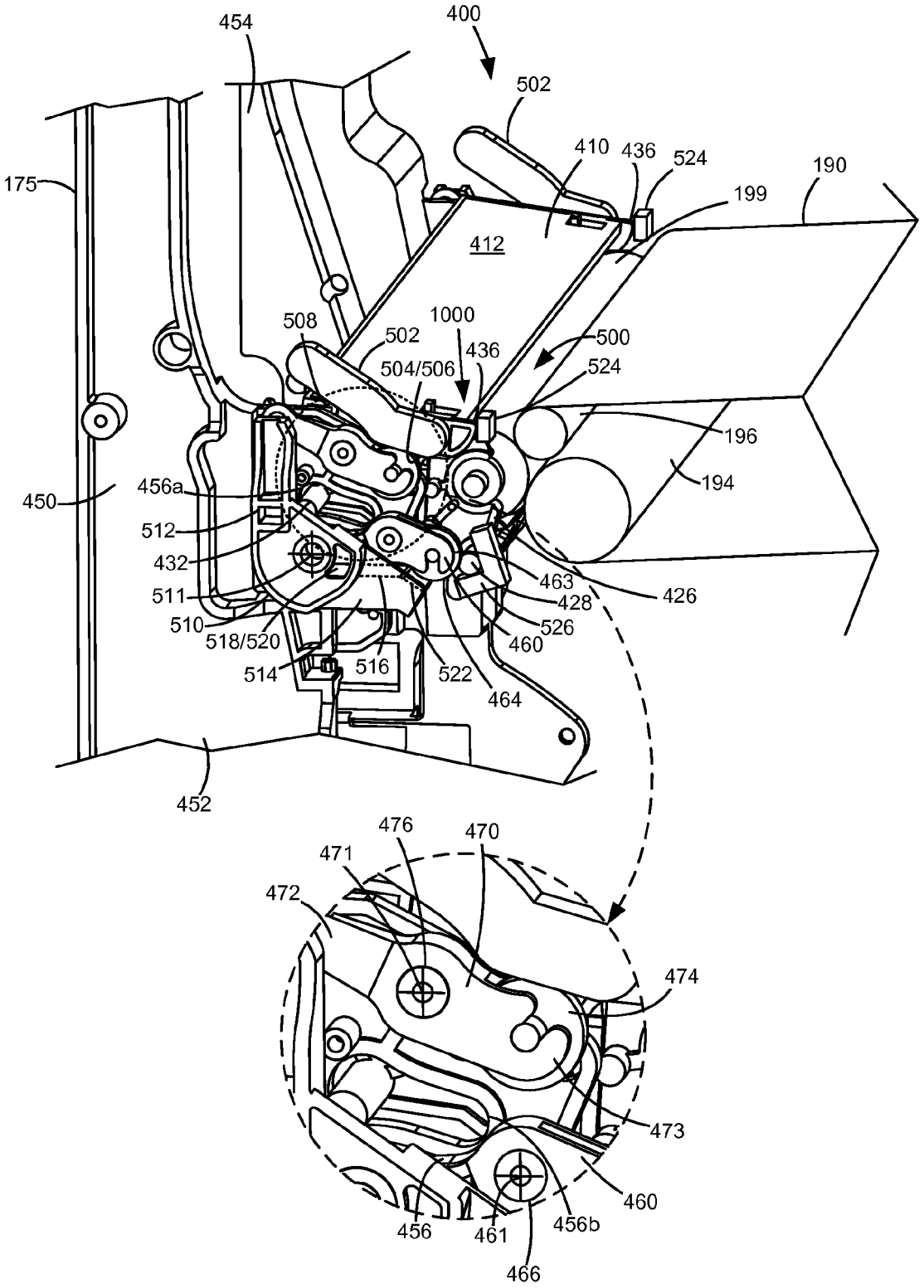
FIGS. 6-10 are sequential perspective views showing the operation of a transfer roll assembly that includes the carriage body shown in FIG. 5 according to one example embodiment.

With reference to FIG. 6, transfer roll assembly 400 includes an inner door frame 450 formed on an inner portion of access door 175. Carriage 410 is mounted on inner door frame 450. In one embodiment, inner door frame 450 is formed integrally with access door 175. In another embodiment, inner door frame 450 is mounted to access door 175 (e.g., by fasteners such as screws, etc.). Inner door frame 450 includes a first frame side 452 and a second frame side 454. Frame sides 452, 454 extend inward from access door 175 toward the interior of image forming device 100 and receive sides 422, 424 of carriage body 412, respectively. In one embodiment, frame sides 452, 454 are substantially mirror images of each other. Each frame side 452, 454 includes a lower elongated slot 456 positioned to receive lower guide post 432 and an upper elongated slot 458 positioned to receive upper guide post 434 (see FIG. 8). Elongated slots 456, 458 extend from a proximal end 456*a*, 458*a* nearer access door 175 to a distal end 456*b*, 458*b* nearer transfer roll 199. In this manner, elongated slots 456, 458 permit lower guide posts 432 and upper guide posts 434, respectively, and carriage body 412 to slide or float toward and away from access door 175 (and ITM 190). Carriage body 412 is biased by one or more biasing members, such as springs (not shown), away from access door 175, toward ITM 190. In the example embodiment illustrated, proximal ends 456*a*, 458*a* of elongated slots 456, 458 are larger than distal ends 456*h*, 458*b* and larger than lower guide posts 432 and upper guide posts 434, respectively, in order to provide additional clearance for lower guide posts 432 and upper guide posts 434, respectively, when access door 175 is closed as discussed in greater detail below.

Image forming device 100 includes a clamping assembly 1000 that clamps transfer roll 199 against ITM 190 as access door 175 is closed and unclamps transfer roll 199 from ITM 190 as access door 175 is opened. In one embodiment, clamping assembly 1000 includes a pair of loading arms 460 and a pair of release arms 470 that are received by a receiving assembly 500 of housing 170 as discussed in greater detail below.

In the embodiment illustrated, inner door frame 450 includes a loading arm 460 pivotally mounted to each frame side 452, 454. Loading arms 460 each have a pivot axis 461. Each loading arm 460 includes a proximal end 462 (FIG. 9) that extends from pivot axis 461 toward access door 175 and a distal end 463 that extends from pivot axis 461 toward transfer roll 199. Each loading arm 460 includes a rotatable roll 464 spaced from pivot axis 461 toward distal end 463. In the example embodiment illustrated, each loading arm 460 is mounted at pivot axis 461 to a mounting post 466 that extends from frame sides 452 and 454. However, loading arms 460 may be mounted to frame sides 452, 454 by any suitable method including, for example, by mounting loading arms 460 to a corresponding slot in frame sides 452 and 454.

Inner door frame 450 also includes a release arm 470 pivotally mounted to each frame side 452, 454 above the corresponding loading arm 460. Release arms 470 each have a pivot axis 471. Like loading arms 460, each release arm 470 includes a proximal end 472 that extends from pivot axis 471 toward access door 175 and a distal end 473 that extends from pivot axis 471 toward transfer roll 199. Each release arm 470 includes a rotatable roll 474 spaced from pivot axis 471 toward distal end 473. In the example embodiment illustrated, each release arm 470 is mounted at pivot axis 471 to a mounting post 476 that extends from frame sides 452 and 454. However, release arms 470 may be mounted to frame sides 452, 454 by any suitable method including, for example, by mounting release arms 470 to a corresponding slot in frame sides 452 and 454. A biasing member, such as an extension spring 478 (FIG. 8), is connected between the proximal end 462 of each loading arm 460 and the proximal end 472 of the adjacent release arm 470 to control the movement of each loading arm 460 relative to its corresponding release arm 470 and vice versa.

Housing 170 of image forming device 100 includes receiving assembly 500 which receives transfer roll assembly 400 when access door 175 is closed and controls the movement of transfer roll assembly 400 as access door 175 opens and closes. Receiving assembly 500 is shown without its supporting structure of housing 170 in FIGS. 6-10 in order to more clearly illustrate the operation of transfer roll assembly 400. Receiving assembly 500 includes a pair of upper guide members 502 positioned in the path of rolls 474 of release arms 470. In the embodiment illustrated, each roll 474 rides along a contoured bottom surface 504 of its corresponding upper guide member 502 as access door 175 opens and closes. In one embodiment, upper guide members 502 are fixedly positioned within housing 170. In the embodiment shown, bottom surface 504 includes a distal portion 506 positioned away from access door 175 that leads into a proximal portion 508 that is positioned nearer access door 175 and is angled upward with respect to distal portion 506.

Receiving assembly 500 also includes a pair of lower guide levers 510 that are pivotally mounted about a pivot axis 511 in housing 170. Each lower guide lever 510 includes a proximal portion 512 that extends from pivot axis 511 toward access door 175 and a distal portion 514 that extends from pivot axis 511 away from access door 175, toward ITM 190. Distal portions 514 of lower guide levers 510 each include a ledge 516 (shown in dashed lines) positioned in the path of the roll 464 of a corresponding loading arm 460. Each roll 464 rides across a top surface 518 of the corresponding ledge 516 as access door 175 opens and closes causing lower guide levers 510 to pivot about pivot axes 511. In the embodiment illustrated, top surface 518 of each ledge 516 includes a proximal portion 520 positioned nearer access door 175 and a distal portion 522 positioned nearer ITM 190. Proximal portions 520 rotate from an upward inclined position to a generally horizontal position as access door is closed as lower guide levers 510 rotate about pivot axes 511 (clockwise as viewed in FIG. 6) as a result of the force applied by rolls 464. In one embodiment, distal portions 522 form an angle of between 180 degrees and 270 degrees with proximal portions 520 such that when proximal portions 520 are in their generally horizontal positions, distal portions 522 slope downward. In the example embodiment shown, guide members 502 are positioned above guide levers 510 but this configuration may be reversed as desired.

Receiving assembly 500 includes a pair of upper stops 524 positioned in the path of stops 436 of carriage body 412 and a pair of lower stops 526 positioned in the path of mounting posts 428, which, in the example embodiment illustrated, serve as additional stops on carriage body 412. In one embodiment, upper and lower stops 524, 526 are attached to a frame of housing 170 supporting ITM 190. Upper and lower stops 524, 526 may take any suitable form. For example, in the embodiment shown, upper stops 524 are formed as simple blocks and lower stops 526 are formed as V-blocks. Upper stops 524 and lower stops 526 limit the forward travel of carriage body 412 when access door 175 is closed. Upper and lower stops 524, 526 are positioned to allow transfer roll 199 to contact ITM 190 and form second transfer nip 198 at a sufficient nip pressure.

FIGS. 6-10 show sequential views illustrating the operation of transfer roll assembly 400 and receiving assembly 500 as access door 175 opens. When access door 175 is closed, the sequence shown in FIGS. 6-10 is reversed. FIG. 6 shows access door 175 in the fully closed position. In this position, transfer roll 199 is positioned against ITM 190 forming second transfer nip 198. Bell cranks 426 are flexed opposite their bias toward access door 175 as a result of the nip force of second transfer nip 198. Stops 436 of carriage body 412 are positioned against upper stops 524 and mounting posts 428 of carriage body 412 are positioned against lower stops 526. Lower guide posts 432 and upper guide posts 434 are positioned near proximal ends 456*a*, 458*a* of lower elongated slots 456 and upper elongated slots 458, respectively. Rolls 464 of lower loading arms 460 are positioned on distal portions 522 of top surfaces 518 of ledges 516 of lower guide levers 510. Rolls 474 of upper release arms 470 are positioned against distal portions 506 of bottom surfaces 504 of upper guide members 502.

When access door 175 is in the closed position, a leveraged load is applied to each lower guide lever 510 through its corresponding lower loading arm 460 clamping carriage body 412 into place with transfer roll 199 positioned against ITM 190. Specifically, loading arms 460 are biased in a clockwise direction as viewed in FIG. 6 by springs 478 as a result of the downward force applied by upper guide members 502 to distal ends 473 (via rolls 474) of upper release arms 470. The spring bias on lower loading arms 460 causes rolls 464 to apply a downward force on lower guide levers 510. The leverage provided by upper release arms 470 and lower loading arms 460 significantly reduces the load on access door 175 and directs the load primarily through the pivot point 176 (FIG. 1) of access door 175 such that forces acting normal to the plane of access door 175 are greatly reduced. When access door 175 is in the closed position, the forces from upper guide members 502 on upper release arms 470 and from lower guide levers 510 on lower loading arms 460 apply a light moment on access door 175 in order to keep access door 175 closed. The angles of bottom surfaces 504 of upper guide members 502 and top surfaces 518 of ledges 516 of lower guide levers 510 may be modified as desired in order to tune the net moment on access door 175.

Figure 7:
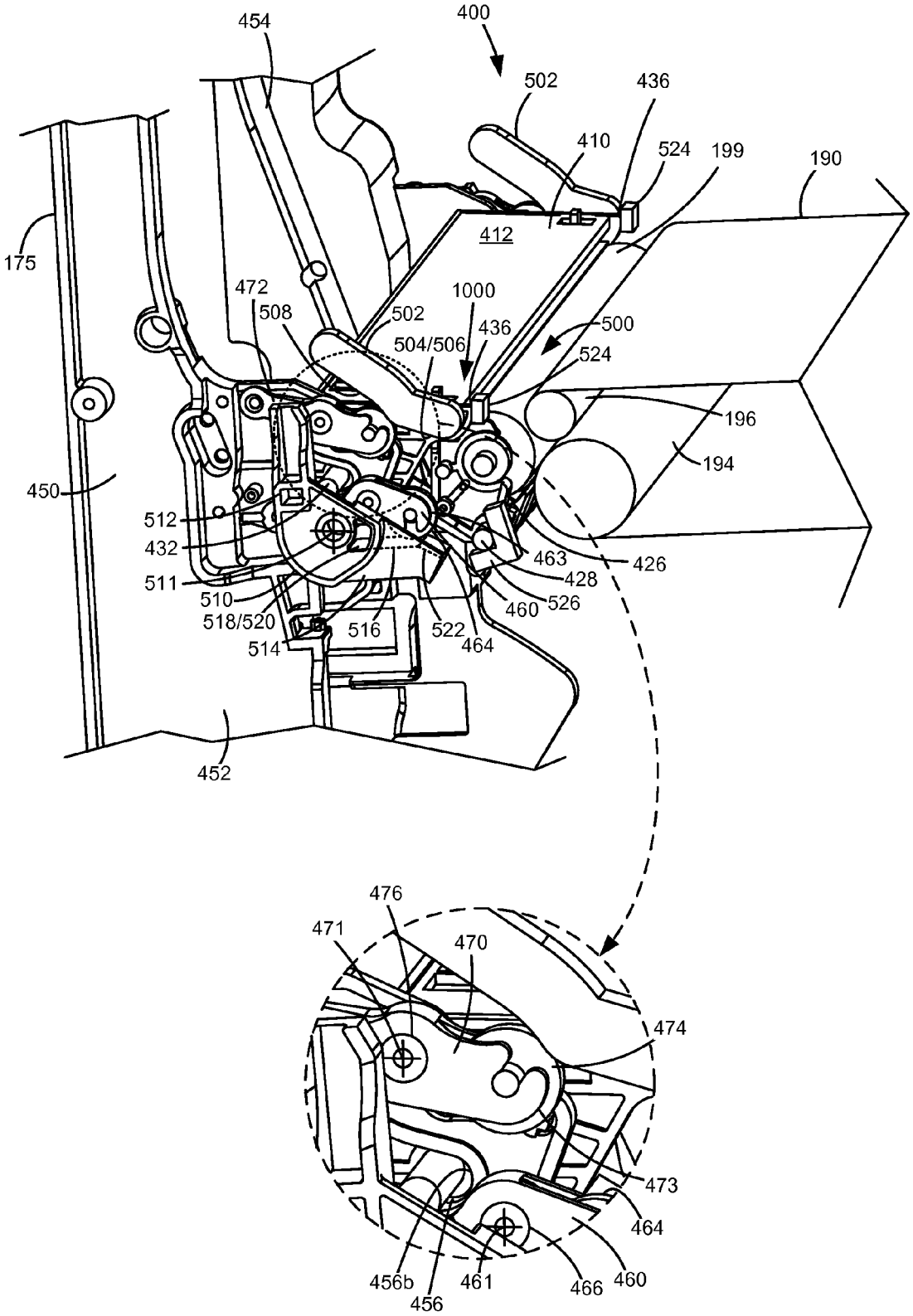

FIG. 7 shows access door 175 as it begins to open. Rolls 464 of lower loading arms 460 have traveled along lower guide levers 510 away from distal portions 522. Rolls 474 of upper release arms 470 have traveled along upper guide members 502 away from distal portions 506. Lower guide posts 432 and upper guide posts 434 have traveled in lower elongated slots 456 and upper elongated slots 458, respectively, away from proximal ends 456*a*, 458*a*. However, as access door 175 begins to open, carriage body 412 remains substantially stationary with transfer roll 199 positioned against ITM 190.

Figure 8:
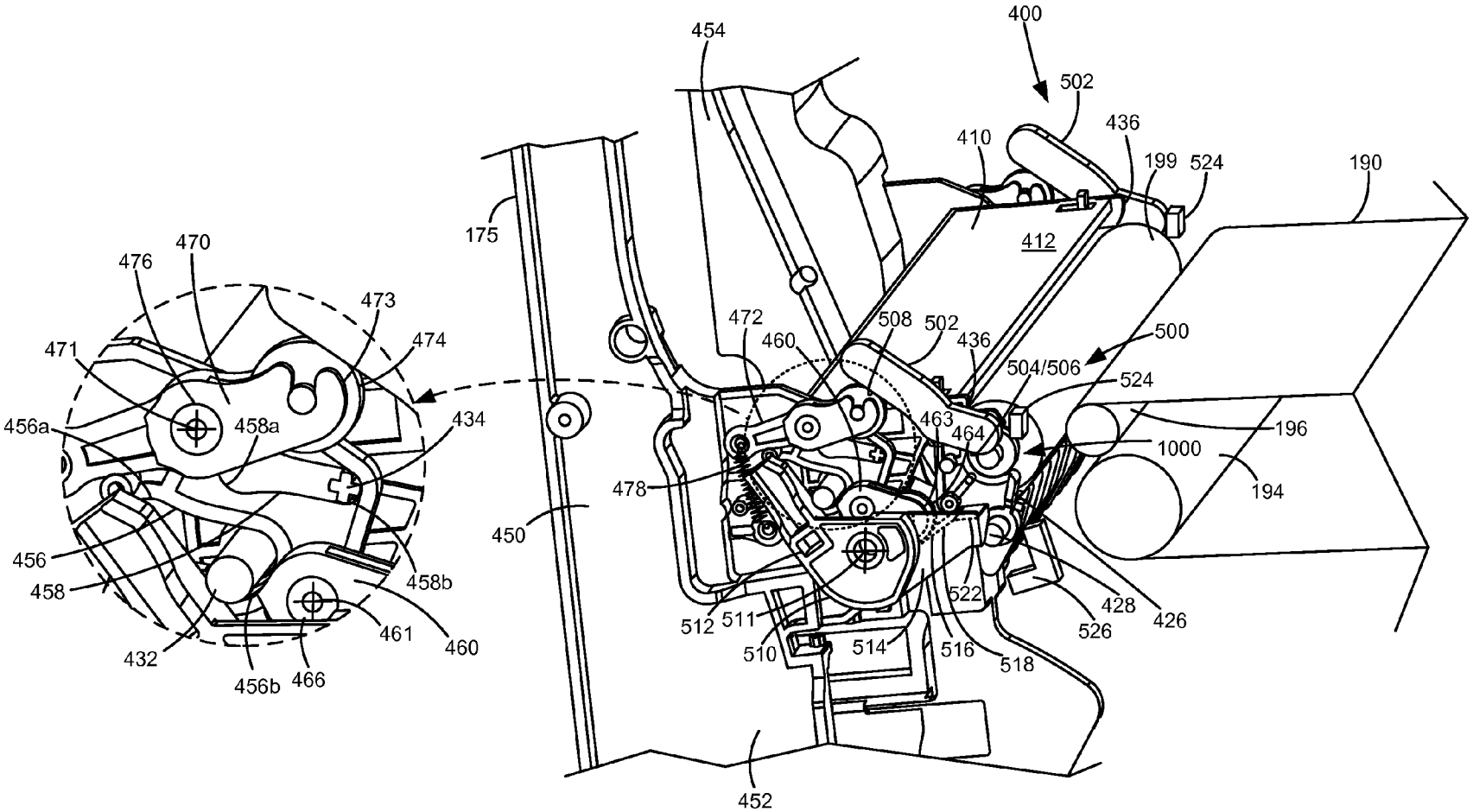

FIG. 8 shows access door 175 opened further. Rolls 464 and 474 continue to travel along lower guide levers 510 and upper guide members 502, respectively, away from distal portions 522, 506. As rolls 464 and rolls 474 travel away from distal portions 522, 506, upper release arms 470 and lower loading arms 460 rotate about pivot axes 471, 461, respectively, in a counter-clockwise direction as viewed in FIG. 8 thereby relieving the load on lower guide levers 510 reducing the force applied to carriage body 412 by door frame 450. Further, any remaining load on lower guide levers 510 is acting on a shorter moment arm in comparison with the load on lower guide levers 510 when access door 175 is fully closed thereby reducing the force applied to carriage body 412 further. This reduces the force required to separate stops 436 from upper stops 524 and mounting posts 428 from lower stops 526. The force on carriage body 412 continues to decline until lower guide posts 432 and upper guide posts 434 complete their travel in lower elongated slots 456 and upper elongated slots 458, respectively, to distal ends 456*b*, 458*b*, as shown in FIG. 8, at which point carriage body 412 moves with access door 175 away from ITM 190. As carriage body 412 moves with access door 175, bell cranks 426 flex in the direction of their bias away from access door 175 and transfer roll 199 begins to separate from ITM 190.

Figure 9:
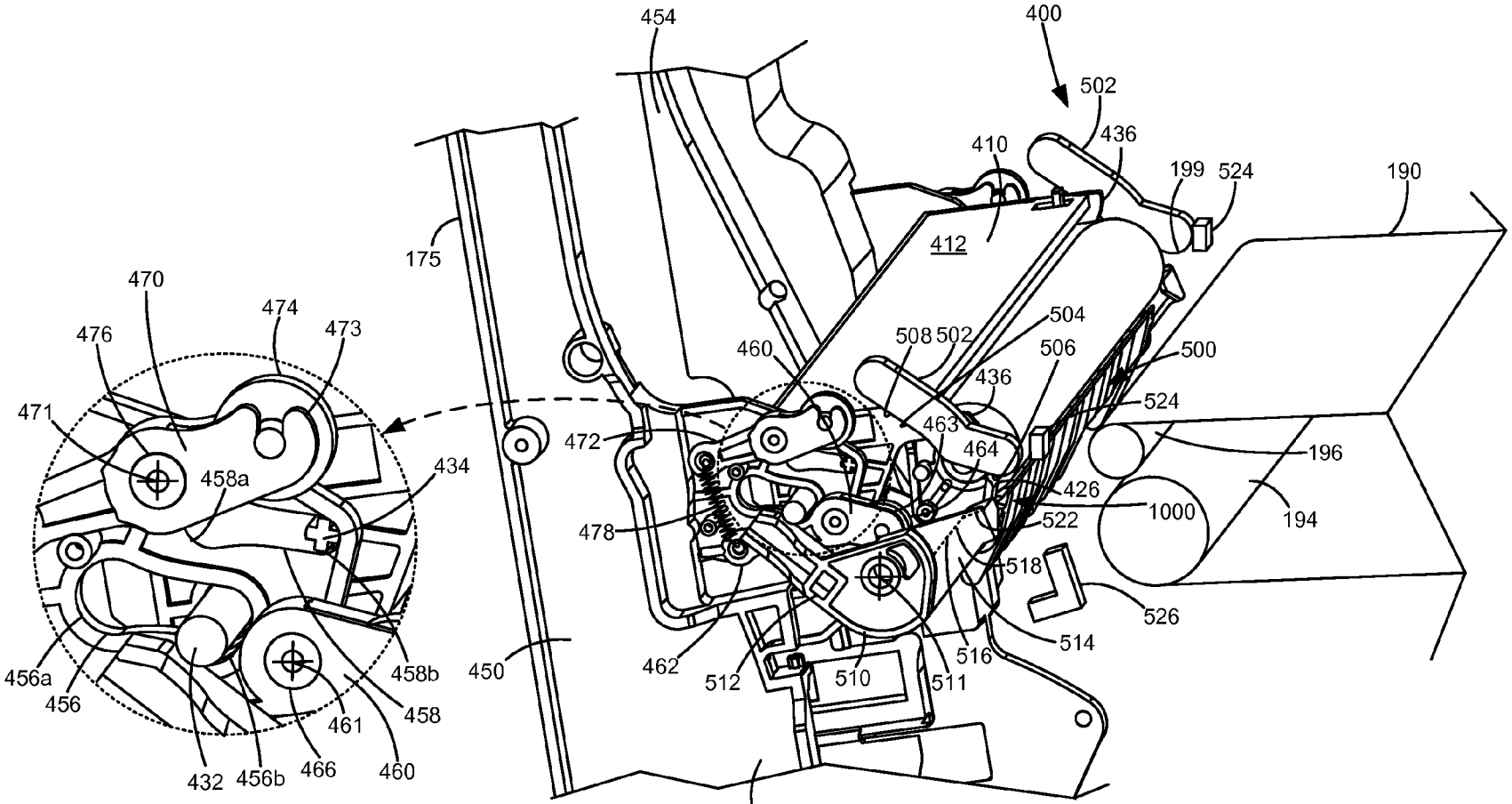
Figure 10:
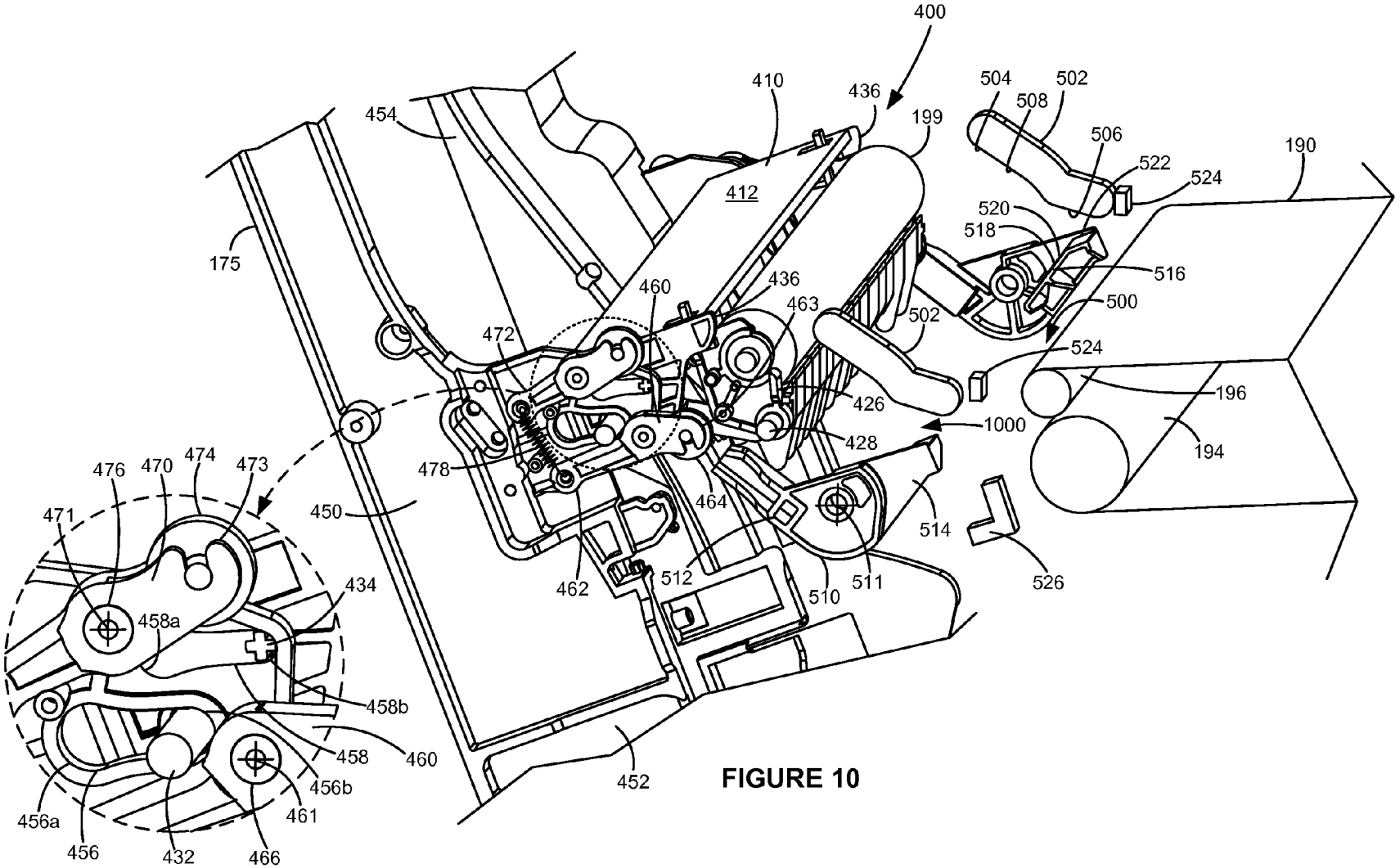

FIG. 9 shows access door 175 opened even further with rolls 464 disengaged from lower guide levers 510 and rolls 474 disengaged from upper guide members 502. At this point, transfer roll 199 is separated from ITM 190. FIG. 10 shows access door 175 opened further allowing a user to clear a media jam in the area of second transfer nip 198 or fuser 120.

The motion of upper release arms 470 relative to lower loading arms 460 is controlled by upper guide members 502 and lower guide levers 510. In one embodiment, during the highest rate of motion of upper release arms 470 and lower loading arms 460, the angular displacement of upper release arms 470 and lower loading arms 460 is substantially synchronous such that, as access door 175 opens, the load on extension springs 478 does not increase beyond the load on extension springs 478 when access door 175 is fully closed. The load on extension springs 478 reduces as lower guide levers 510 rotate in a counter-clockwise direction as viewed in FIGS. 6-10 as access door 175 is opened. As carriage body 412 is pulled away from ITM 190, the load on extension springs 478 reduces sharply. As a result, transfer roll assembly 400 permits a user to manually open and close access door 175 without the need for assistance from a motor or other powered device and requires low operator force from the user. As access door 175 is closed, the reaction loads are directed through the pivot of access door 175 after carriage body 412 is loosely in position permitting the force required by a user to close access door 175 to remain low. After carriage body 412 is loosely in position, as access door 175 is closed further, a heavier clamping load is automatically applied to carriage body 412 by lower guide levers 510 in order to reach a desired nip pressure at second transfer nip 198. In one embodiment, as access door 175 is closed, the applied force required by the user remains less than about 15% of the available clamping load applied by lower guide levers 510 when access door 175 is closed.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. An image forming device, comprising:

a housing;

an access door on the housing manually movable between a closed position and an open position permitting access to an interior of the housing;

a carriage mounted on an inner portion of the access door;

a first roll rotatably mounted to the carriage, the first roll forming a nip with a second member positioned in the interior of the housing when the access door is in the closed position and the first roll being spaced away from the second member when the access door is in the open position, the carriage being free to move relative to the access door and being biased away from the access door toward the second member;

a clamping assembly configured to clamp the first roll against the second member to form the nip as the access door is closed and unclamp the first roll from the second member as the access door is opened;

an inner door frame on the inner portion of the access door having a first side and a second side, the first side having a first upper pivotal arm and a first lower pivotal arm, the second side having a second upper pivotal arm and a second lower pivotal arm, the first upper pivotal arm and the first lower pivotal arm being connected by a first spring, the second upper pivotal arm and the second lower pivotal arm being connected by a second spring, each of the first upper pivotal arm, the second upper pivotal arm, the first lower pivotal arm and the second lower pivotal arm is pivotal independent of movement of the access door; and the clamping assembly including a first guide member positioned to guide the movement of one of the first upper pivotal arm and the first lower pivotal arm as the access door is opened and closed and a second guide member positioned to guide the movement of one of the second upper pivotal arm and the second lower pivotal arm as the access door is opened and closed, the clamping assembly further including a first pivotal guide lever and a second pivotal guide lever, the first pivotal guide lever being actuatable by the other of the first upper pivotal arm and the first lower pivotal arm and the second pivotal guide lever being actuatable by the other of the second upper pivotal arm and the second lower pivotal arm to clamp the first roll against the second member to form the nip as the access door is closed and unclamp the first roll from the second member as the access door is opened.

2. The image forming device of claim 1, wherein the second member is an intermediate transfer member positioned to receive a toned image from each of a plurality of photoconductive drums and to convey the toned images received from the plurality of photoconductive drums at the nip.

3. The image forming device of claim 1, wherein the clamping assembly reduces the force required to manually open and close the access door relative to the load applied by the clamping assembly to clamp the first roll against the second member to form the nip when the access door is in the closed position.

4. The image forming device of claim 1, further comprising:

the carriage having a first side and a second side, a first guide member on the first side of the carriage and a second guide member on the second side of the carriage; and the inner door frame on the inner portion of the access door having a first elongated slot receiving the first guide member on the first side of the carriage and a second elongated slot receiving the second guide member on the second side of the carriage, the first and second elongated slots permitting the first and second guide members, respectively, and the carriage to slide toward and away from the access door.

5. The image forming device of claim 4, wherein the first guide member on the first side of the carriage includes a first upper guide member and a first lower guide member, the second guide member on the second side of the carriage includes a second upper guide member and a second lower guide member, the first elongated slot includes a first upper elongated slot receiving the first upper guide member and a first lower elongated slot receiving the first lower guide member, the second elongated slot includes a second upper elongated slot receiving the second upper guide member and a second lower elongated slot receiving the second lower guide member, the first and second upper and lower elongated slots permitting the first and second upper and lower guide members, respectively, and the carriage to slide toward and away from the access door.

6. The image forming device of claim 1, further comprising the carriage including at least one bell crank pivotally mounted on a distal portion of the carriage relative to the access door, the first roll being mounted on the at least one bell crank and biased relative to the carriage away from the access door.

7. The image forming device of claim 6, further comprising at least one mounting post defining a pivot axis of the bell crank, the at least one mounting post being positioned to limit the travel of the carriage toward the second member upon the at least one mounting post contacting a corresponding stop in the housing when the access door is closed.

8. The image forming device of claim 1, wherein a distal portion of each of the first and second upper and lower pivotal arms relative to the access door includes a rotatable roll positioned to engage the respective first and second guide members and pivotal guide levers, the first spring connects a proximal portion of the first upper pivotal arm to a proximal portion of the first lower pivotal arm, and the second spring connects a proximal portion of the second upper pivotal arm to a proximal portion of the second lower pivotal arm.

9. The image forming device of claim 8, wherein the first guide member includes a first contoured surface on which the roll of the corresponding first upper pivotal arm or first lower pivotal arm travels and the second guide member includes a second contoured surface on which the roll of the corresponding second upper pivotal arm or second lower pivotal arm travels.

10. An electrophotographic image forming device, comprising:

a housing;

an intermediate transfer member in an interior portion of the housing positioned to receive a toned image from each of a plurality of photoconductive drums at a series of first transfer nips and to convey the toned images received from the plurality of photoconductive drums at a second transfer nip formed between the intermediate transfer member and a transfer roll;

an access door on the housing manually pivotal between a closed position and an open position permitting access to the intermediate transfer member;

an inner door frame on an inner portion of the access door having a first side and a second side;

a carriage mounted on the inner door frame, the transfer roll being rotatably mounted to the carriage, the transfer roll forming the second transfer nip with the intermediate transfer member when the access door is in the closed position and being spaced away from the intermediate transfer member when the access door is in the open position, the carriage being free to move relative to the access door and being biased away from the access door toward the intermediate transfer member;

a first upper pivotal arm and a first lower pivotal arm on the first side of the inner door frame, a second upper pivotal arm and a second lower pivotal arm on the second side of the inner door frame, the first upper pivotal arm and the first lower pivotal arm being connected by a first spring, the second upper pivotal arm and the second lower pivotal arm being connected by a second spring, each of the first upper pivotal arm the second upper pivotal arm, the first lower pivotal arm and the second lower pivotal arm is pivotal about a respective pivot axis that is not coaxial with a pivot axis of the access door;

a first guide member positioned to guide the movement of one of the first upper pivotal arm and the first lower pivotal arm as the access door is opened and closed and a second guide member positioned to guide the movement of one of the second upper pivotal arm and the second lower pivotal arm as the access door is opened and closed; and a first pivotal guide lever and a second pivotal guide lever, the first pivotal guide lever being actuatable by the other of the first upper pivotal arm and the first lower pivotal arm and the second pivotal guide lever being actuatable by the other of the second upper pivotal arm and the second lower pivotal arm to clamp the transfer roll against the intermediate transfer member to form the second transfer nip as the access door is closed and unclamp the transfer roll from the intermediate transfer member as the access door is opened.

11. The image forming device of claim 10, further comprising:

the carriage having a first side and a second side, a first guide post on the first side of the carriage and a second guide post on the second side of the carriage; and a first elongated slot on the first side of the inner door frame receiving the first guide post and a second elongated slot on the second side of the inner door frame receiving the second guide post, the first and second elongated slots permitting the first and second guide posts, respectively, and the carriage to slide toward and away from the access door.

12. The image forming device of claim 11, wherein the first guide post includes a first upper guide post and a first lower guide post, the second guide post includes a second upper guide post and a second lower guide post, the first elongated slot includes a first upper elongated slot receiving the first upper guide post and a first lower elongated slot receiving the first lower guide post, the second elongated slot includes a second upper elongated slot receiving the second upper guide post and a second lower elongated slot receiving the second lower guide post, the first and second upper and lower elongated slots permitting the first and second upper and lower guide posts, respectively, and the carriage to slide toward and away from the access door.

13. The image forming device of claim 10, further comprising the carriage including at least one bell crank pivotally mounted on a distal portion of the carriage relative to the access door, the transfer roll being mounted on the at least one bell crank and biased relative to the carriage away from the access door.

14. The image forming device of claim 13, further comprising at least one mounting post defining a pivot axis of the bell crank, the at least one mounting post being positioned to limit the travel of the carriage toward the intermediate transfer member upon the at least one mounting post contacting a corresponding stop in the housing when the access door is closed.

15. The image forming device of claim 10, wherein a distal portion of each of the first and second upper and lower pivotal arms relative to the access door includes a rotatable roll positioned to engage the respective first and second guide members and pivotal guide levers, the first spring connects a proximal portion of the first upper pivotal arm to a proximal portion of the first lower pivotal arm, and the second spring connects a proximal portion of the second upper pivotal arm to a proximal portion of the second lower pivotal arm.

16. The image forming device of claim 15, wherein the first guide member includes a first contoured surface on which the roll of the corresponding first upper pivotal arm or first lower pivotal arm travels and the second guide member includes a second contoured surface on which the roll of the corresponding second upper pivotal arm or second lower pivotal arm travels.

* * * * *